US006074263A

United States Patent [19]

Sanders et al.

[11] Patent Number: 6,074,263

[45] Date of Patent: Jun. 13, 2000

[54] METHODS OF MANUFACTURING BALLASTS AND STARTER ASSEMBLIES USED IN GAS DISCHARGE LAMPS

[75] Inventors: Stuart E. Sanders, Brandon, Miss.; John L. Cox, Hermitage, Tenn.; David S. Stratton, Douglas, Ariz.; Theodore Miller, Jr., Hattiesburg; Mark R. Opperthauser, Brandon, both of Miss.

[73] Assignee: MagneTek, Inc., Nashville, Tenn.

[21] Appl. No.: 09/168,722

[22] Filed: Oct. 8, 1998

Related U.S. Application Data

[62] Division of application No. 08/686,661, Jul. 26, 1996, Pat. No. 5,852,344.

[51] Int. Cl.[7] ..... H01J 61/30

[52] U.S. Cl. ..... 445/23

[58] Field of Search ..... 445/23, 26

[56] References Cited

U.S. PATENT DOCUMENTS

| | | | |
|---|---|---|---|
| 4,347,460 | 8/1982 | Latassa et al. | 315/63 |
| 4,495,443 | 1/1985 | Cummings | 315/58 |
| 4,879,494 | 11/1989 | Tuttle | 315/61 |
| 4,931,696 | 6/1990 | Brower | 615/61 |

OTHER PUBLICATIONS

Drawing: MagneTek, Inc. Jun. 1994.

*Primary Examiner*—Kenneth J. Ramsey
*Attorney, Agent, or Firm*—Waddey & Patterson; Mark J. Patterson

[57] ABSTRACT

Methods of manufacturing ballasts and starter assemblies used in gas discharge lamps are disclosed. One embodiment of a starter assembly includes a one-piece plastic enclosure for a glow bulb which is used as a starter for a fluorescent lamp. The enclosure has a latching hinged lid, a partition wall to isolate the glow bulb leads, and integral strain relief. The glow bulb enclosure is preferably mounted inside a ballast assembly and the glow bulb leads are preferably ultrasonically welded to the ballast power supply wires. Methods of reducing manufacturing expenses by physically separating the glow bulb from other ballast components are also disclosed.

20 Claims, 3 Drawing Sheets

METHODS OF MANUFACTURING BALLASTS AND STARTER ASSEMBLIES USED IN GAS DISCHARGE LAMPS

This is a division of U.S. patent application Ser. No. 08/686,661, filed Jul. 26, 1996, entitled "Enclosure For Glow Bulb Starter Used With Gas Discharge Lamps" by Sanders, et al., now U.S. Pat. No. 5,852,344. Per 35 U.S.C. 120 this application, or a portion thereof, is entitled to and claims an effective filing date of Jul. 26, 1996.

Be it known that we, Stuart E. Sanders, a citizen of the United States, residing at 108 East Sunset Drive, Brandon, Miss. 39042; John L. Cox, a citizen of the United States and residing at 6001 Old Hickory Boulevard, Hermitage, Tenn. 37076; David S. Stratton, a citizen of the United States, residing at 1402 San Antonio Avenue, Apt. D-24, Douglas, Ariz. 85607; Theodore Miller, Jr., a citizen of the United States, residing at 802 Elizabeth Avenue, Hattiesburg, Miss. 39401-3531; and Mark R. Opperthauser, a citizen of the United States, residing at 4021 Brookwood Drive, Brandon, Miss. 39042, have invented a new and useful "Methods of Manufacturing Ballasts and Starter Assemblies Used in Gas Discharge Lamps."

BACKGROUND OF THE INVENTION

This invention pertains generally to glow bulbs which are conventionally used as starting devices for gas discharge lamps. More specifically, this invention pertains to techniques for electrically, thermally, and mechanically insulating a glow bulb starter from the ballast and other components associated with a gas discharge lamp. In particular, methods of manufacturing starter assemblies and ballasts are taught. U.S. patent application Ser. No. 08/686,661, filed Jul. 26, 1996, entitled "Enclosure For Glow Bulb Starter Used With Gas Discharge Lamps" by Sanders, et al., which more fully describes a device for carrying out embodiments of the present invention, is hereby incorporated by reference.

Fluorescent lamps provide illumination by generating an electrical arc and radiation inside a lamp tube. The radiation activates a fluorescent coating applied to the inner surface of the tube. To produce the arc and radiation inside the tube, a voltage is applied to the electrodes of the lamp at sufficiently high levels to generate an arc across electrodes. However, conventional fluorescent lamps must be "started" by ionizing the gas within the lamp so that the breakdown voltage needed to initiate the arc between the electrodes is reduced to a reasonably low level.

To provide the starting voltage and to control the current to the lamp, a ballast is used. In many low wattage fluorescent lamps, a magnetic ballast is used in conjunction with a glow bulb starter. The ballast limits the current to the lamp while the glow bulb starter creates an arc-inducing voltage spike across the lamp after pre-heating the lamp electrodes. Generally, the glow bulb starting device is mounted internal to the ballast enclosure. This presents a number of problems with the integrity, cost, and reliability of the ballast assembly, both in manufacturing and in operation.

First, some level of electrical isolation must be provided between the glow bulb and the other components of the ballast. Second, the glow bulb must be protected from thermal shock caused when potting compound is poured at high temperature into the ballast enclosure. Third, a secure and relatively efficient means must be used to electrically connect the leads on the glow bulb to power supply leads inside the ballast enclosure.

Several thermal and electrical isolation techniques have been used in the prior art but with limited success. Some manufacturers isolate the glow bulb lead wires from each other by covering them with dielectric tubing and tape and then wrapping the entire glow bulb and glow bulb lead assembly in Mylar tape. Other manufacturers use a paper insulation material to isolate the glow bulb from the other components in the ballast. In either case, the wrapping of the glow bulb with tape or other material is highly labor intensive and does not provide a high level of mechanical or thermal protection for the glow bulb itself. Accordingly, the glow bulbs which are installed and protected using prior art techniques are prone to failure due to thermal effects or mechanical shock.

What is needed, then, is a device for electrically insulating glow bulb leads from each other and from the other internal components of a ballast, which provides a high level of thermal and mechanical protection to the glow bulb, and which reduces the cost of installing and assembling the glow bulb within the lamp ballast enclosure. This device is presently lacking in the prior art.

SUMMARY OF THE INVENTION

Methods for manufacturing starter assemblies used in gas discharge lamps, and methods for manufacturing ballasts utilizing starter assemblies have been invented. The methods include providing low-cost but enhanced electrical, thermal, and mechanical protection to a glow bulb starter assembly when installed inside a ballast enclosure by installing a glow bulb in a protective enclosure.

One method of manufacturing a starter assembly for a ballast used in a gas discharge lamp consistent with the present invention comprises placing a glow bulb having a size and shape into a protective housing for the glow bulb. Preferably the protective housing has a size and shape generally conforming to the size and shape of the glow bulb. This is shown in FIG. 1.

The present invention also comprises a method of manufacturing a ballast used in a gas discharge lamp. The method of manufacturing a ballast used in a gas discharge lamp generally includes providing a plurality of ballast components including a glow bulb and remaining components. The remaining components typically include ballasts, capacitors, thermal protectors, and the like. The method also includes placing the ballast components into a ballast enclosure and separating the glow bulb from the remaining ballast components. The step of separating the glow bulb generally includes placing the glow bulb in a protective enclosure, wherein the protective enclosure electrically isolates the glow bulb from the remaining ballast components. This is shown in FIG. 6.

Accordingly, an object of the present invention is to provide methods of electrically, thermally, and mechanically insulating a glow bulb or equivalent arc-inducing voltage spike devices.

Another object is to improve the integrity of glow bulb assemblies, and thereby improve the integrity of gas discharge lamps. Thus, a broader objective is to improve the integrity and reliability of gas discharge lamps in general. This includes improving safety by providing the appropriate levels of electrical, thermal, and mechanical isolation for components of the gas discharge lamp.

Another object of the present invention if to reduce the need for labor intensive glow bulb starter assembly practices. Thus, a broader object of the present invention is to reduce costs of gas discharge lamps in general, and ballast manufacturing in particular. A corollary of the objective to reduce labor intensive practices is to reduce the impact manual labor costs have in manufacturing decisions.

An object of the invention is to provide simple methods for isolating ballast components from each other. This includes isolating glow bulb leads from each other and provide isolation, i.e. protection, for the glow bulb itself.

Another object of the present invention is to teach methods of securing and electrically connecting wires and leads in a relatively efficient manner. This includes teaching methods for counter acting forces causing strain on the connections.

Another object of the present invention is to teach methods for reducing failure of gas discharge components in general, and ballast components in particular, due to thermal shock and mechanical shock. Accordingly, an object of the present invention is to teach methods of providing enhanced, yet low-cost, electrical, thermal, and mechanical protection for glow bulb assemblies.

Other advantages and objectives will be apparent from the following detailed description of preferred embodiments with reference to the attached drawings, and the invention as set forth in the claims.

DESCRIPTION OF THE PREFERRED EMBODIMENT

Figure 1:
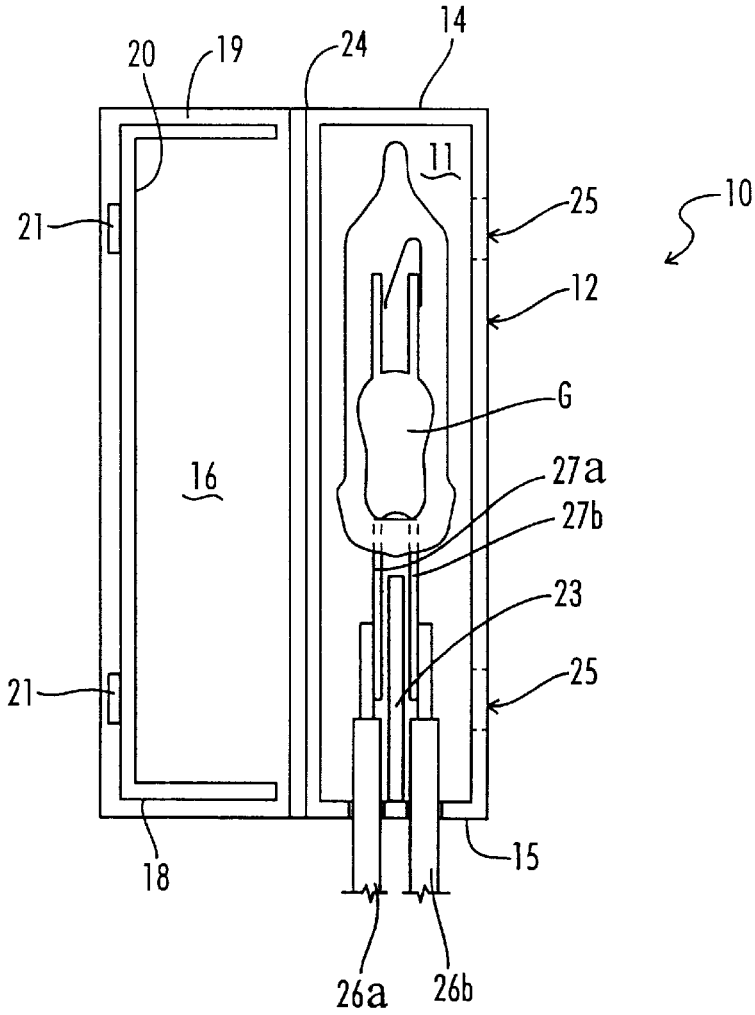
FIG. 1 is a plan view of the glow bulb enclosure of the present invention with the enclosure lid in the open position showing the glow bulb inside the housing of the enclosure.
Figure 2:
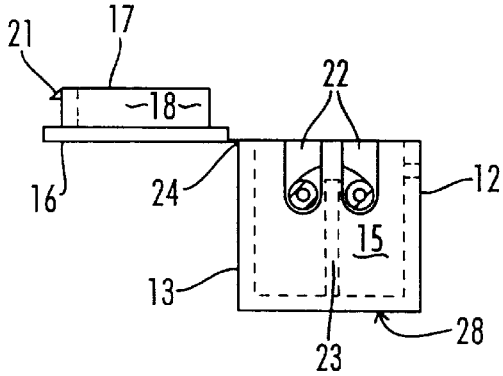
FIG. 2 is an end view of the glow bulb enclosure of FIG. 1 with the lid in the open position.
Figure 3:
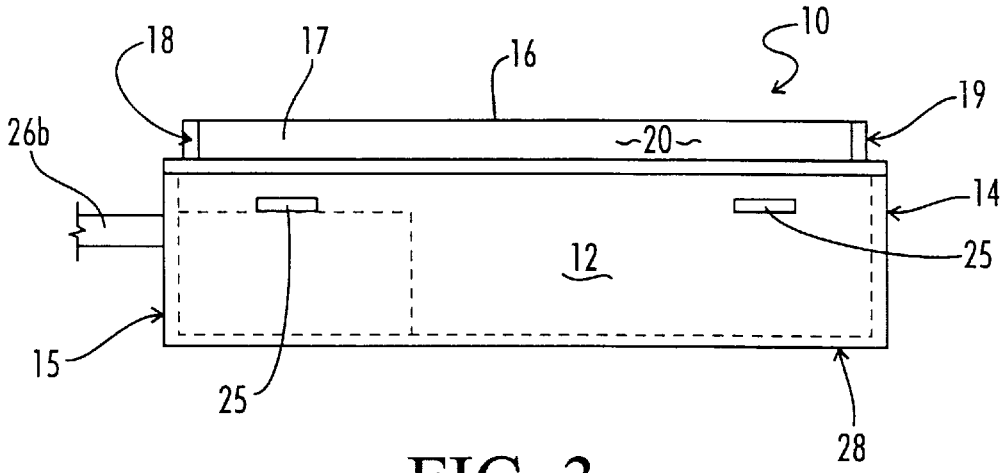
FIG. 3 is a side view of the glow bulb enclosure of FIG. 1.
Figure 4:
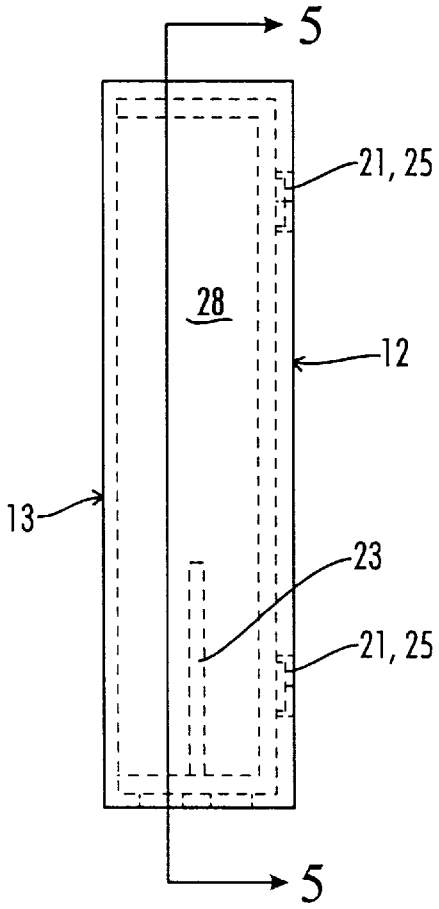
FIG. 4 is a bottom view of the glow bulb enclosure of the present invention with the glow bulb removed
Figure 5:
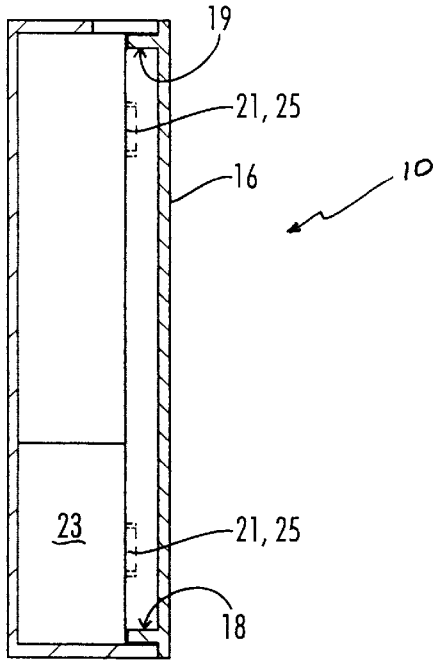
FIG. 5 is a sectional view of the glow bulb enclosure looking along line A—A of FIG. 4.

FIGS. 1 through 5 illustrate a novel glow bulb enclosure 10 which may be used to carry out embodiments of the present invention. The glow bulb enclosure 10 is more fully described in: U.S. patent application Ser. No. 08/686,661, filed Jul. 26, 1996, entitled "Enclosure For Glow Bulb Starter Used With Gas Discharge Lamps" by Sanders, et al., which is hereby incorporated by reference. FIGS. 1, 2, and 3 show the enclosure 10 with a conventional glow bulb G installed. The enclosure 10 is preferably molded into a one-piece plastic device to form a housing 11 and a corresponding lid 16. The housing has a generally rectangular shape defined by first and second end walls 14, 15, first and second side walls 12, 13, and a bottom wall 28. The top of the housing 11 is left open so that the glow bulb G can be placed inside the housing 11. The dimensions of the housing side, end, and bottom walls 12, 13, 14, 15, and 28 can vary as long as they generally conform to the size and shape of the glow bulb G.

It is important to provide a means for electrically isolating the wire leads 27*a* and 27*b* from each other and to do so in a manner that minimizes manual operations during assembly. Accordingly, the housing 11 includes an integral partition wall 23 which, as best seen on FIGS. 1 and 2, extends vertically upward from the bottom wall 28 to a line between the wire leads 27*a, b* of the glow bulb G. An opening must also be provided into the enclosure 10 for entry of power supply wires 26*a* and 26*b* which are electrically connected inside the housing 11 to the glow bulb wire leads 27*a, b*. Preferably, a pair of slotted wire openings 22 are molded into the second side wall 15 of the housing so that the insulated power supply wires 26*a, b* can pass through and be positioned around the partition wall 23 as shown on FIG. 1.

The power supply wires 26 are soldered or, in the preferred embodiment, ultrasonically welded to the glow bulb wire leads 27. The glow bulb G is placed inside the housing 11 and the lid 16 is pivoted into a closed position over the opening of the housing. Preferably, the lid 16 is attached to the upper margin of second side wall 13 by a living hinge 24. The outer margins of the lid 16 will preferably be congruent with the size and shape of the opening into the housing 11*b* (i.e., the same size and shape as the bottom wall 28). To provide an additional sealing and latching function, the lid also includes a U-shaped inner sealing structure 17 defined by vertically descending short wall sections 18 and 19, and an interconnecting long wall section 20. The sealing structure 17 is stepped-in slightly from the outer margins of the lid 16 so that the wall sections 18, 19, and 20 will provide a slight frictional fit with the inner surfaces of corresponding walls 15, 14, and 12 respectively of the housing 11.

To provide a further means to secure the lid 16 in its closed position, triangular-shaped latching tabs 21 are integrally molded to and extend laterally outward from the long wall section 20 underneath the lid 16 (FIG. 2). Corresponding latching slots 25 are formed into first side wall 12 of the housing 11. As best seen on FIGS. 4 and 5, when the lid 11 is pivoted into the closed position, the latching tabs 21 are received by the latching slots 25 so that the lid 11 stays closed unless and until the tabs 21 are physically forced out of their respective slots 25.

Because the wire leads 27 on the glow bulb are relatively fragile, strain relief is important to minimize the forces that can be transmitted by external movement of the power supply wires 26. This function can be performed by the short wall section 18. When the lid 16 is moved to the closed position, the lower edge of the short wall section 18 contacts the supply wires 26 immediately after they pass through the slotted openings 22. Thus, when the lid 16 is latched in the closed position, a strain relief force is applied to the power supply wires 26 between the short wall section 18 and the end wall 15 of the housing 11.

Figure 6:
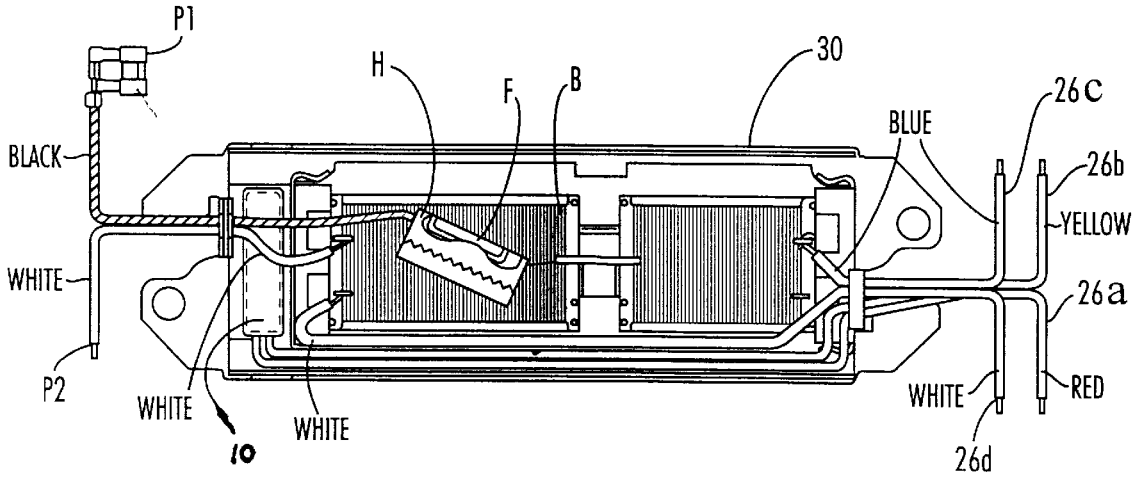
FIG. 6 is a plan view of the glow bulb enclosure of the present invention as installed inside a fluorescent lamp ballast enclosure, with the ballast enclosure cover removed.

FIG. 6 shows a fluorescent lamp ballast and glow bulb assembly, with the cover of the ballast enclosure 30 removed. The glow bulb enclosure 10 of this invention, with the glow bulb G (not shown) inside, is placed inside the ballast enclosure 30 between the magnetic ballast B and a side wall of the ballast enclosure 30. The glow bulb power supply wires 26*a* and 26*b* enter through an opposite side wall of the ballast enclosure 30. Wires 26*a*–26*d* are connected to the lamp terminals (not shown). Main power wires P1 and P2 supply power to the ballast and glow bulb assembly. A thermal protector F inside insulation H provides overheating protection.

Using the glow bulb enclosure 10 as shown and described substantially reduces labor cost. Rather than having to insulate the connections between the power supply wires and glow bulb leads using a manual wrapping operation, the enclosure 10 itself provides this protection. As compared to manually wrapping the entire glow bulb with tape or other material, the enclosure 10 provides an enhanced level of thermal and mechanical shock resistance.

Preferably, the glow bulb enclosure 10 will be molded from low cost plastic which can tolerate the heat generated inside the ballast enclosure 30, such as 6/6 nylon.

A plethora of methods for manufacturing starter assemblies for ballasts used in gas discharge lamps and methods for manufacturing ballasts used in gas discharge lamps will now be describe. Variations of these exemplary methods will be apparent to those of skill in the art.

One method of manufacturing a starter assembly for a ballast used in a gas discharge lamp consistent with the present invention comprises placing a glow bulb having a size and shape into a protective housing for the glow bulb. Preferably the protective housing has a size and shape generally conforming to the size and shape of the glow bulb. This is shown in FIG. 1.

An interior of the protective enclosure generally conforming to the glow bulb would also work. The interior need not be tight fitting, just sufficient to provide a container which will provide a satisfactory environment for the glow bulb to operate and for the discharge lamp to operate. For example, the protective enclosure may provide electrical isolation from other ballast components, mechanical isolation from external mechanical, i.e. physical, shock, or isolation for thermal shock, or any expedient combination. In this context, isolation for a given property is generally synonymous with insulation from the property of concern.

Preferably, the method includes closing a lid on the housing, thereby forming a protective enclosure for the glow bulb. The method may further include hingedly attaching the lid to the housing. These steps are shown in FIGS. 2–3.

The method of assembling the starter preferably includes physically isolating a pair of glow bulb leads from each other. Generally this is done by utilizing a partition wall in the housing and positioning the leads on either side of the partition wall. A device to accomplish this is shown in FIG. 1, in which the partition wall 23 separates the glow bulb leads.

One embodiment of the method includes passing a pair of power supply wires through an opening in an end wall of the protective enclosure; and connecting the power supply wires to a pair of glow bulb leads. This is shown in FIG. 1. One method of connecting the leads to the wires includes ultrasonically welding the leads to the wires.

One method of manufacturing a starter includes relieving strain on the power supply wires as the power supply wires pass through the opening in the end wall of the protective enclosure. A method for relieving strain on the power supply wires may include contacting the power supply wires with an inner wall member of the lid when the lid is closed and applying a strain relief force to the power supply wires between the lid inner wall member and the end wall of the protective enclosure when the lid is closed. FIGS. 1–3 depict the power supply wires 26*a* and 26*b* supported in the end wall 15 of the protective enclosure 11 such that lid wall member 18 will contact the power supply wires 26*a* and 26*b* when the lid is closed and strain caused my external movement of the wires 26*a* and 26*b* will be relieved, or counter acted.

The method of starter assembly may further include placing the protective enclosure into a ballast enclosure.

The present invention also comprises a method of manufacturing a ballast used in a gas discharge lamp. The method of manufacturing a ballast used in a gas discharge lamp generally includes providing a plurality of ballast components including a glow bulb and remaining components. The remaining components typically include ballasts, capacitors, thermal protectors, and the like. The method also includes placing the ballast components into a ballast enclosure and separating the glow bulb from the remaining ballast components. The step of separating the glow bulb generally includes placing the glow bulb in a protective enclosure, wherein the protective enclosure electrically isolates the glow bulb from the remaining ballast components.

The ballast manufacturing may further include mechanically protecting the glow bulb from mechanical shocks, wherein the protective enclosure provides mechanical protection for the glow bulb. The method may also include utilizing the protective enclosure to provides thermal protection for the glow bulb from thermally from thermal shock. Typically the thermal shock is due to potting compounds being poured into the ballast enclosure, but other thermal events may be protected against as well.

One method of manufacturing the ballast includes mounting a ballast inside the ballast enclosure, wherein the remaining ballast components includes the ballast, and passing power supply wires inside the ballast enclosure through the protective enclosure. The power supply wires are electrically connected to the to glow bulb leads inside the protective enclosure. And the method generally includes closing the lid on the protective enclosure.

The step of passing the power supply wires through the protective enclosure may comprise positioning the power supply wires in a pair of slotted wire openings formed in the protective enclosure. See FIG. 2, which depicts power supply wires 26*a* and 26*b* positioned in slotted openings 22.

The method of manufacturing a ballast may further include minimizing strain on the power supply wires caused by movement of the power supply wires external to the ballast enclosure.

In one embodiment of the method, the step of closing the lid comprises sealing the lid to a housing of the protective enclosure. This may include forming a slight frictional fit between inner surfaces of walls of the housing and corresponding wall sections of the lid. See FIGS. 1–5, and above detailed discussion of the enclosure 10 shown in FIGS. 1–5. The step of closing the lid may further comprise the step of latching the lid to a housing of the protective enclosure.

One embodiment of the method of manufacturing a ballast includes positioning the protective enclosure adjacent a wall of the ballast enclosure and adjacent a ballast mounted in the ballast enclosure, wherein the remaining ballast components includes the ballast. See FIG. 6. Other expedient locations will be apparent to those of skill in the art.

Another method of manufacturing a ballast used in a gas discharge lamp includes providing a glow bulb and placing the glow bulb in a protective enclosure. Preferably, the protective enclosure has an interior generally conforming to the size and shape of the glow bulb. The method generally includes placing the protective enclosure in a ballast enclosure. Though, arranging the protective enclosure external to and proximate with the ballast enclosure would generally provide operable equivalence.

Additionally, though the present invention has been described by reference to a "glow bulb," the methods and techniques taught and claimed herein are equally applicable to any arc-inducing voltage spike device capable of creating an arc-inducing voltage spike across the lamp after preheating the lamp electrodes. Thus, the term "glow bulb" is used for simplicity and clarity and is intended to encompass all equivalent arc-inducing voltage spike devices.

Thus, although there have been described particular embodiments of the present invention of a new and useful Methods of Manufacturing Ballasts and Starter Assemblies Used in Gas Discharge Lamps, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What is claimed is:

1. A method of manufacturing a starter assembly for a ballast used in a gas discharge lamp comprising the steps of:

providing a glow bulb having a size and shape;

providing a protective housing for the glow bulb having a size and shape generally conforming to the size and shape of the glow bulb;

placing the glow bulb into the housing; and closing a lid on the housing, thereby forming a protective enclosure for the glow bulb.

2. The method of claim 1, further comprising the step of hingedly attaching the lid to the housing.

3. The method of claim 1, further comprising the step of physically isolating a pair of glow bulb leads from each other.

4. The method of claim 3, wherein the step of physically isolating the glow bulb leads from each other comprises the steps of:

providing a partition wall in the housing; and positioning the leads on either side of the partition wall.

5. The method of claim 1, further comprising the steps of:

passing a pair of power supply wires through an opening in an end wall of the protective enclosure; and connecting the power supply wires to a pair of glow bulb leads.

6. The method of claim 5, further comprising the step of relieving strain on the power supply wires as the power supply wires pass through the opening in the end wall of the protective enclosure.

7. The method of claim 6, wherein the step of relieving strain on the power supply wires comprises the steps of:

contacting the power supply wires with an inner wall member of the lid when the lid is closed; and applying a strain relief force to the power supply wires between the lid inner wall member and the end wall of the protective enclosure when the lid is closed.

8. The method of claim 5, wherein the step of connecting the power supply wires to the glow bulb leads comprises the step of ultrasonically welding the wires to the leads.

9. The method of claim 1, further comprising the step of placing the protective enclosure into a ballast enclosure.

10. A method of manufacturing a ballast used in a gas discharge lamp comprising the steps of:

providing a plurality of ballast components including a glow bulb and remaining ballast components;

placing the ballast components into a ballast enclosure; and separating the glow bulb from the remaining ballast components including the step of placing the glow bulb in a rigid protective enclosure, wherein the protective enclosure electrically isolates the glow bulb from the remaining ballast components.

11. The method of claim 10, further comprising the step of mechanically protecting the glow bulb from mechanical shocks, wherein the protective enclosure provides mechanical protection for the glow bulb.

12. The method of claim 10, further comprising the step of thermally protecting the glow bulb from thermal shock, wherein the protective enclosure provides thermal protection for the glow bulb.

13. A method of manufacturing a ballast used in a gas discharge lamp comprising the steps of:

providing a plurality of ballast components including a glow bulb and remaining ballast components;

placing the ballast components into a ballast enclosure; and separating the glow bulb from the remaining ballast components including the step of placing the glow bulb in a protective enclosure, wherein the protective enclosure electrically isolates the glow bulb from the remaining ballast components;

mounting a ballast inside the ballast enclosure, wherein the remaining ballast components includes the ballast;

passing power supply wires inside the ballast enclosure through the protective enclosure;

electrically connecting the power supply wires to glow bulb leads inside the protective enclosure; and closing a lid on the protective enclosure.

14. The method of claim 13, wherein the step of passing the power supply wires through the protective enclosure comprises the step of positioning the power supply wires in a pair of slotted wire openings formed in the protective enclosure.

15. The method of claim 13, wherein the step of electrically connecting the power supply wires to the glow bulb leads comprises ultrasonically welding the wires to the leads.

16. The method of claim 13, further comprising the step of minimizing strain on the power supply wires caused by movement of the power supply wires external to the ballast enclosure.

17. The method of claim 13, wherein the step of closing the lid further comprises the step of:

sealing the lid to a housing of the protective enclosure, including the step of forming a slight frictional fit between inner surfaces of walls of the housing and corresponding wall sections of the lid.

18. The method of claim 13, wherein the step of closing the lid further comprises the step of latching the lid to a housing of the protective enclosure.

19. The method of claim 10, further comprising the step of conforming an interior of the protective enclosure to a general size and shape of the glow bulb.

20. A method of manufacturing a ballast used in a gas discharge lamp comprising the steps of:

providing a glow bulb;

placing the glow bulb in a rigid protective enclosure, the protective enclosure having an interior generally conforming to a size and shape of the glow bulb; and placing the protective enclosure in a ballast enclosure.

* * * * *